US011749878B2

(12) United States Patent
Chang et al.

(10) Patent No.: US 11,749,878 B2
(45) Date of Patent: Sep. 5, 2023

(54) MOBILE DEVICE

(71) Applicant: Acer Incorporated, New Taipei (TW)

(72) Inventors: Kun-Sheng Chang, New Taipei (TW); Ching-Chi Lin, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 254 days.

(21) Appl. No.: 17/152,105

(22) Filed: Jan. 19, 2021

(65) Prior Publication Data

US 2021/0367327 A1 Nov. 25, 2021

(30) Foreign Application Priority Data

May 21, 2020 (TW) ..... 109116872

(51) Int. Cl.
*H01Q 1/24* (2006.01)
*H01Q 1/38* (2006.01)
*H01Q 5/392* (2015.01)

(52) U.S. Cl.
CPC ..... *H01Q 1/243* (2013.01); *H01Q 1/38* (2013.01); *H01Q 5/392* (2015.01)

(58) Field of Classification Search
CPC ..... H01Q 1/243; H01Q 1/38; H01Q 5/392; H01Q 1/2291; H01Q 5/364; H01Q 5/378; H01Q 9/42; H01Q 1/2266
See application file for complete search history.

(56) References Cited

U.S. PATENT DOCUMENTS 7,081,854 B2 7/2006 Ying et al.
10,530,044 B2 1/2020 Huang et al.
2005/0168384 A1 8/2005 Wang et al.
2005/0212706 A1* 9/2005 Ying ..... H01Q 19/005 343/702
2008/0278398 A1* 11/2008 Tsai ..... H01Q 1/2266 343/850

(Continued)

FOREIGN PATENT DOCUMENTS

TW 200835055 A 8/2008

OTHER PUBLICATIONS

Chinese language office action dated Jan. 5, 2021, issued in application No. TW 109116872.

(Continued)

*Primary Examiner* — Hai V Tran
*Assistant Examiner* — Michael M Bouizza
(74) *Attorney, Agent, or Firm* — McClure, Qualey & Rodack, LLP

(57) ABSTRACT

A mobile device includes a main radiation element, a parasitic radiation element, and an additional radiation element. The main radiation element has a first notch. The main radiation element includes a feeding region coupled to a signal source, and a grounding region coupled to a ground voltage. The parasitic radiation element is coupled to the ground voltage. The parasitic radiation element is adjacent to the feeding region of the main radiation element. The additional radiation element is coupled to the main radiation element. The additional radiation element and the parasitic radiation element substantially extend in the same direction. An antenna structure is formed by the main radiation element, the parasitic radiation element, and the additional radiation element.

13 Claims, 6 Drawing Sheets

(56) References Cited

U.S. PATENT DOCUMENTS

| | | | | |
|---|---|---|---|---|
| 2009/0316612 | A1 | 12/2009 | Poilasne et al. | |
| 2014/0078001 | A1 | 3/2014 | Matsuoka et al. | |
| 2014/0256388 | A1 | 9/2014 | Lin et al. | |
| 2017/0005414 | A1* | 1/2017 | Yang | H01Q 13/10 |
| 2018/0375191 | A1* | 12/2018 | Chi | H01Q 21/0087 |
| 2020/0076049 | A1 | 3/2020 | Chang et al. | |

OTHER PUBLICATIONS

Extended European Search Report dated Jul. 12, 2021, issued in application No. EP 21153416.9.

* cited by examiner

MOBILE DEVICE

CROSS REFERENCE TO RELATED APPLICATIONS

This application claims priority of Taiwan Patent Application No. 109116872 filed on May 21, 2020, the entirety of which is incorporated by reference herein.

BACKGROUND OF THE INVENTION

Field of the Invention

The disclosure generally relates to a mobile device, and more particularly, it relates to a mobile device and an antenna structure.

Description of the Related Art

With the advancements being made in mobile communication technology, mobile devices have become more common.

Antennas are indispensable elements of mobile devices that support wireless communication. However, antennas tend to be affected by nearby metal elements. Thus, antenna elements may experience interference, and overall communication quality may suffer as a result. Alternatively, the SAR (Specific Absorption Rate) may be too high to meet legal requirements. Accordingly, there is a need to propose a novel solution for solving the problems of the prior art.

BRIEF SUMMARY OF THE INVENTION

In an exemplary embodiment, the disclosure is directed to a mobile device that includes a main radiation element, a parasitic radiation element, and an additional radiation element. The main radiation element has a first notch. The main radiation element includes a feeding region coupled to a signal source, and a grounding region coupled to a ground voltage. The parasitic radiation element is coupled to the ground voltage. The parasitic radiation element is adjacent to the feeding region. The additional radiation element is coupled to the main radiation element. The additional radiation element and the parasitic radiation element substantially extend in the same direction. An antenna structure is formed by the main radiation element, the parasitic radiation element, and the additional radiation element.

In some embodiments, the main radiation element substantially has a rectangular shape with a first corner, a second corner, a third corner and a fourth corner. The feeding region is positioned at the first corner. The additional radiation element is coupled to the second corner.

In some embodiments, the parasitic radiation element substantially has an L-shape.

In some embodiments, the additional radiation element substantially has a straight-line shape.

In some embodiments, the first notch of the main radiation element is positioned between the second corner and the third corner. The main radiation element further has a second notch which is adjacent to the fourth corner.

In some embodiments, a coupling gap is formed between the parasitic radiation element and the main radiation element. The width of the coupling gap is shorter than or equal to 1 mm.

In some embodiments, the distance between the additional radiation element and the parasitic radiation element is longer than or equal to 7 mm.

In some embodiments, the antenna structure covers a first frequency band from 2400 MHz to 2500 MHz, a second frequency band from 5100 MHz to 5600 MHz, and a third frequency band from 5600 MHz to 5900 MHz.

In some embodiments, the length of the parasitic radiation element is substantially equal to 0.25 wavelength of the third frequency band.

In some embodiments, the mobile device includes a metal back cover and a keyboard frame. The metal back cover includes a cutting retraction region. The antenna structure is disposed between the keyboard frame and the metal back cover. The antenna structure has a vertical projection on the metal back cover, and the whole vertical projection is inside the cutting retraction region.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
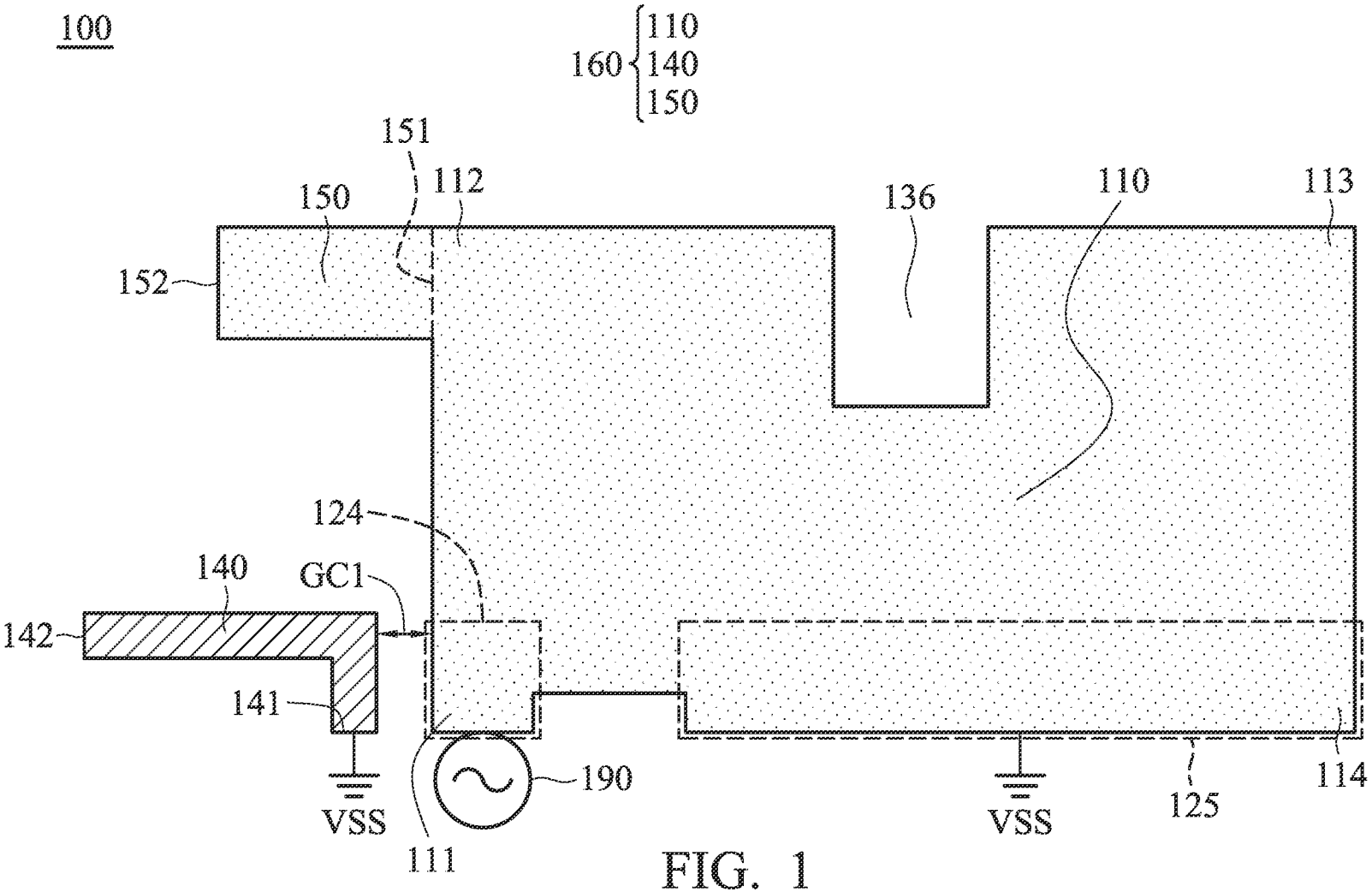
FIG. 1 is a top view of a mobile device according to an embodiment of the invention.

FIG. 1 is a top view of a mobile device 100 according to an embodiment of the invention. For example, the mobile device 100 may be a smartphone, a tablet computer, or a notebook computer. As shown in FIG. 1, the mobile device 100 at least includes a main radiation element 110, a parasitic radiation element 140, and an additional radiation element 150. The main radiation element 110, the parasitic radiation element 140, and the additional radiation element 150 may all be made of metal materials, such as copper, silver, aluminum, iron, or their alloys. It should be understood that the mobile device 100 may further include other components, such as a display device, a speaker, a touch control module, a power supply module, and/or a housing, although they are not displayed in FIG. 1.

The main radiation element 110 may substantially have a rectangular shape with a first corner 111, a second corner 112, a third corner 113, and a fourth corner 114. The main radiation element 110 includes a feeding region 124 coupled to a signal source 190, and a grounding region 125 coupled to a ground voltage VSS. The signal source 190 may be an RF (Radio Frequency) module. The ground voltage VSS may be provided by a system ground plane (not shown). The feeding region 124 may be positioned at the first corner 111 of the main radiation element 110. In addition, the main radiation element 110 has a first notch 136, which may substantially have a square shape or a small rectangular shape. In some embodiments, the first notch 136 of the main radiation element 110 is positioned between the second corner 112 and the third corner 113 (e.g., it is substantially positioned at the central point between the second corner 112 and the third corner 113).

The parasitic radiation element 140 may substantially have an L-shape. In some embodiments, the parasitic radiation element 140 is independent of the main radiation element 110. The parasitic radiation element 140 is adjacent to the feeding region 124 of the main radiation element 110. A coupling gap GC1 may be formed between the parasitic radiation element 140 and the feeding region 124 of the main radiation element 110. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing therebetween is reduced to 0). Specifically, the parasitic radiation element 140 has a first end 141 and a second end 142. The first end 141 of the parasitic radiation element 140 is coupled to the ground voltage VSS. The second end 142 of the parasitic radiation element 140 is an open end, which extends away from the main radiation element 110. The parasitic radiation element 140 is at least partially parallel to the additional radiation element 150.

The additional radiation element 150 may substantially have a straight-line shape. Specifically, the additional radiation element 150 has a first end 151 and a second end 152. The first end 151 of the additional radiation element 150 is coupled to the second corner 112 of the main radiation element 110. The second end 152 of the additional radiation element 150 is an open end. In some embodiments, the second end 152 of the additional radiation element 150 and the second end 142 of the parasitic radiation element 140 substantially extend in the same direction (e.g., both of them may be far away from the main radiation element 110).

In a preferred embodiment, an antenna structure 160 is formed by the main radiation element 110, the parasitic radiation element 140, and the additional radiation element 150. The antenna structure 160 may be a planar and disposed on the same surface of a dielectric substrate, such as an FR4 (Flame Retardant 4) substrate, a PCB (Printed Circuit Board), or an FCB (Flexible Circuit Board), but it is not limited thereto.

Figure 2:
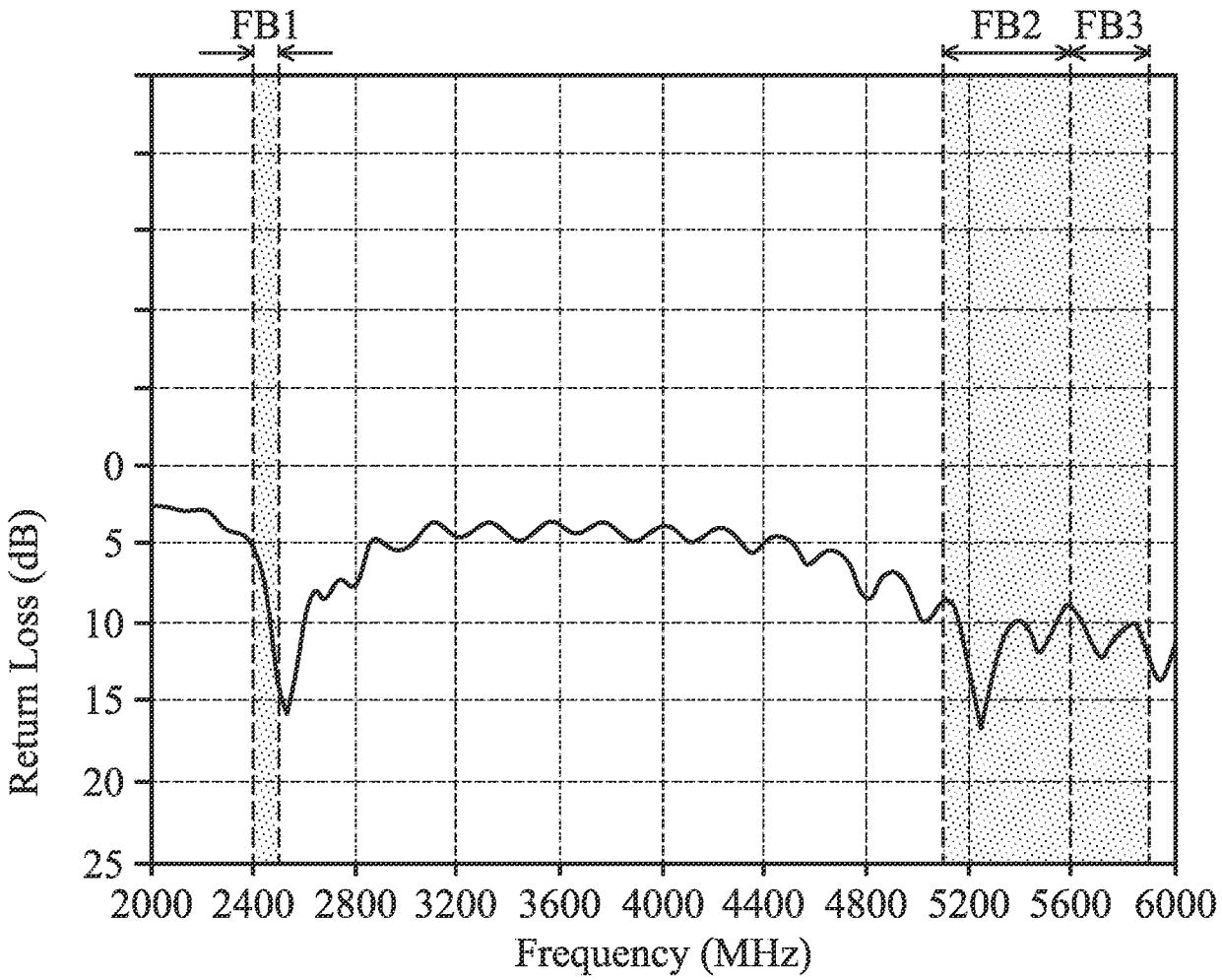
FIG. 2 is a diagram of return loss of an antenna structure of a mobile device according to an embodiment of the invention.

FIG. 2 is a diagram of return loss of the antenna structure 160 of the mobile device 100 according to an embodiment of the invention. The horizontal axis represents operation frequency (MHz), and the vertical axis represents the return loss (dB). According to the measurement of FIG. 2, the antenna structure 160 can cover a first frequency band FB1, a second frequency band FB2, and a third frequency band FB3. For example, the first frequency band FB1 may be from 2400 MHz to 2500 MHz, the second frequency band FB2 may be from 5100 MHz to 5600 MHz, and the third frequency band FB3 may be from 5600 MHz to 5900 MHz. Thus, the antenna structure 160 of the mobile device 100 can support at least the wideband operations of WLAN (Wireless Local Area Networks) 2.4 GHz/5 GHz.

Figure 3:
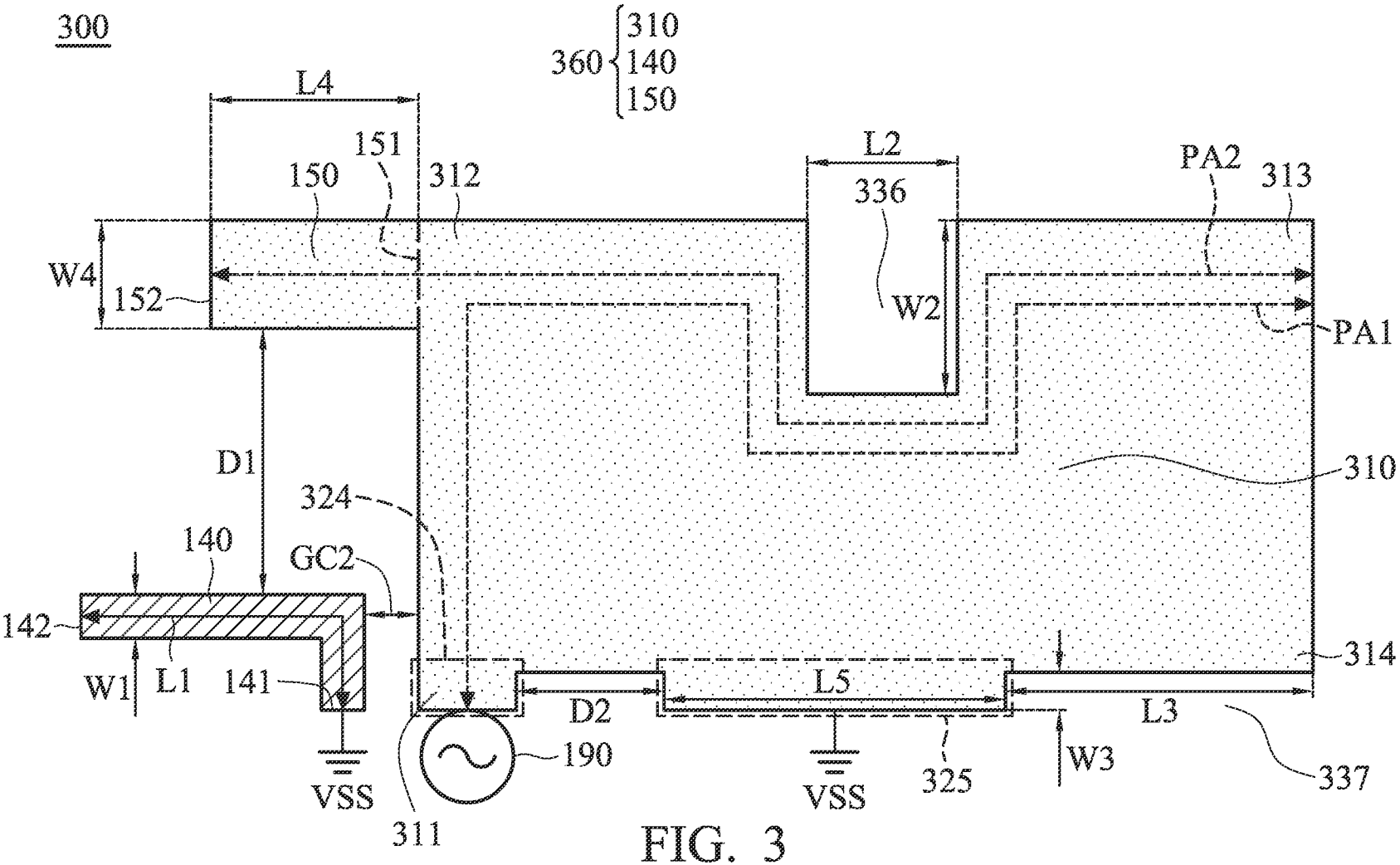
FIG. 3 is a top view of a mobile device according to another embodiment of the invention.

FIG. 3 is a top view of a mobile device 300 according to another embodiment of the invention. FIG. 3 is similar to FIG. 1. In the embodiment of FIG. 3, a main radiation element 310 of the mobile device 300 has a first notch 336 and a second notch 337, and includes a feeding region 324 coupled to the signal source 190 and a grounding region 325 coupled to the ground voltage VSS. The main radiation element 310 may substantially have a rectangular shape with a first corner 311, a second corner 312, a third corner 313, and a fourth corner 314. Specifically, the second notch 337 of the main radiation element 310 may substantially have a thin and long rectangular shape, which is adjacent to the fourth corner 314. The structural features of the parasitic radiation element 140 and the additional radiation element 150 have been described in the embodiment of FIG. 1, and they will not be illustrated again herein. An antenna structure 360 is formed by the main radiation element 310, the parasitic radiation element 140, and the additional radiation element 150.

Figure 4:
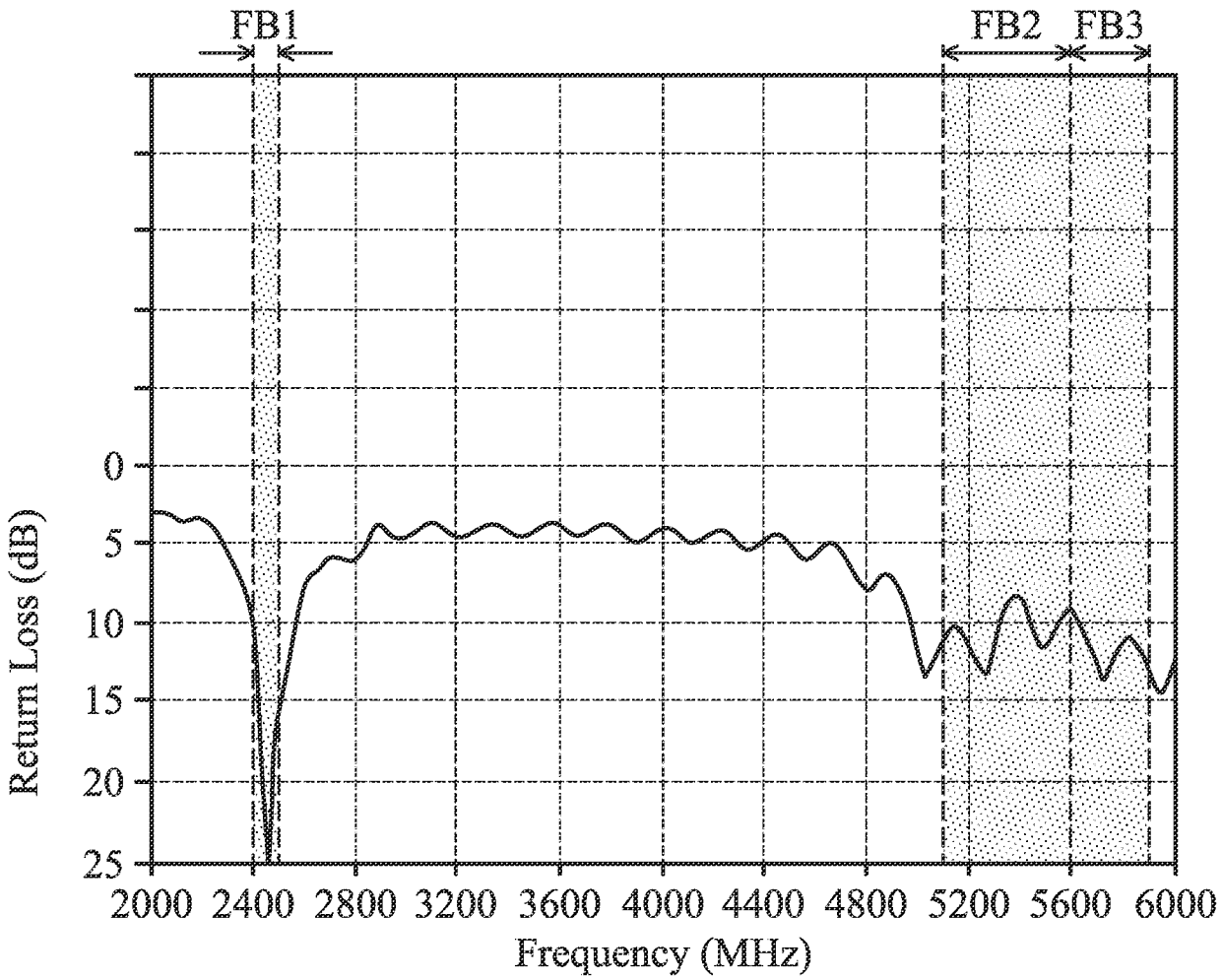
FIG. 4 is a diagram of return loss of an antenna structure of a mobile device according to another embodiment of the invention.

FIG. 4 is a diagram of return loss of the antenna structure 360 of the mobile device 300 according to another embodiment of the invention. The horizontal axis represents operation frequency (MHz), and the vertical axis represents the return loss (dB). According to the measurement of FIG. 4, the antenna structure 360 can also cover the first frequency band FB1, the second frequency band FB2, and the third frequency band FB3 as mentioned above. Thus, the antenna structure 360 can also support the wideband operations of WLAN 2.4 GHz/5 GHz. It should be noted that after the second notch 337 is added to the main radiation element 310, the impedance matching of the antenna structure 360 is significantly improved within the first frequency band FB1.

In some embodiments, the operation principles of the antenna structure 360 of the mobile device 300 are as follows. A first current path PA1 is formed from the feeding region 324 through the second corner 312 and the first notch 336 to the third corner 313, and it can be excited to generate the first frequency band FB1. A second current path PA2 is formed from the second end 152 of the additional radiation element 150 through the second corner 312 and the first notch 336 to the third corner 313, and it can be excited to generate the second frequency band FB2. According to practical measurements, the incorporation of the first notch 336 can decrease the central frequency of the second frequency band FB2 (e.g., decreased by about 300 MHz), and also increase the design independency between the first frequency band FB1 and the second frequency band FB2. Furthermore, the parasitic radiation element 140 can be excited by the main radiation element 110 using a coupling mechanism, so as to generate the third frequency band FB3 and increase the operation bandwidth of WLAN 5 GHz.

In some embodiments, the element sizes of the antenna structure 360 of the mobile device 300 are as follows. The length of the first current path PA1 may be substantially equal to 0.25 wavelength ($\lambda/4$) of the first frequency band FB1 of the antenna structure 360. The length of the second current path PA2 may be substantially equal to 0.5 wavelength (λ/2) of the second frequency band FB2 of the antenna structure 360. The length L1 of the parasitic radiation element 140 may be substantially equal to 0.25 wavelength (λ/4) of the third frequency band FB3 of the antenna structure 360. The length L2 of the first notch 336 of the main radiation element 310 may be from 2 mm to 4 mm. The width W2 of the first notch 336 of the main radiation element 310 may be from 3 mm to 5 mm. The length L3 of the second notch 337 of the main radiation element 310 may be shorter than or equal to 10 mm. The width W3 of the second notch 337 of the main radiation element 310 may be shorter than or equal to 2 mm. The length L4 of the additional radiation element 150 may be shorter than or equal to 5 mm (e.g., from 2 mm to 3 mm). The width W4 of the additional radiation element 150 may be greater than the width W1 of the parasitic radiation element 140. For example, the width W4 of the additional radiation element 150 may be from 2 to 4 times the width W1 of the parasitic radiation element 140. The length L5 of the grounding region 325 of the main radiation element 310 may be from 3 mm to 7 mm. The width of a coupling gap GC2 between the parasitic radiation element 140 and the feeding region 324 of the main radiation element 310 may be shorter than or equal to 1 mm. The distance D1 between the additional radiation element 150 and the parasitic radiation element 140 may be longer than or equal to 7 mm. The distance D2 between the feeding region 324 and the grounding region 325 of the main radiation element 310 may be from 2 mm to 4 mm. The total length of the antenna structure 360 may be about 30 mm. The total width of the antenna structure 360 may be about 12 mm. The above ranges of element sizes are calculated and obtained according to many experiment results, and they help to optimize the bandwidth and impedance matching of the antenna structure 360.

For example, the proposed antenna structure 160 (or 360) may be applied to a convertible mobile device 500, which includes an upper cover housing 511, a display device 512, a keyboard frame 513, a metal back cover 514, and a hinge element 515. By using the hinge element 515, the convertible mobile device 500 can operate in a notebook mode or a tablet mode. It should be understood that the upper cover housing 511, the display device 512, the keyboard frame 513, and the metal back cover 514 are equivalent to the so-called "A-component", "B-component", "C-component", and "D-component" in the field of notebook computers. The proposed antenna structure 160 (or 360) may be disposed in the space between the keyboard frame 513 and the metal back cover 514. It should be noted that the metal back cover 514 includes a cutting retraction region 520, so as to make the whole device thin and light. The antenna structure 160 (or 360) has a vertical projection on the metal back cover 514, and the whole vertical projection is inside the cutting retraction region 520 of the metal back cover 514.

Figure 5:
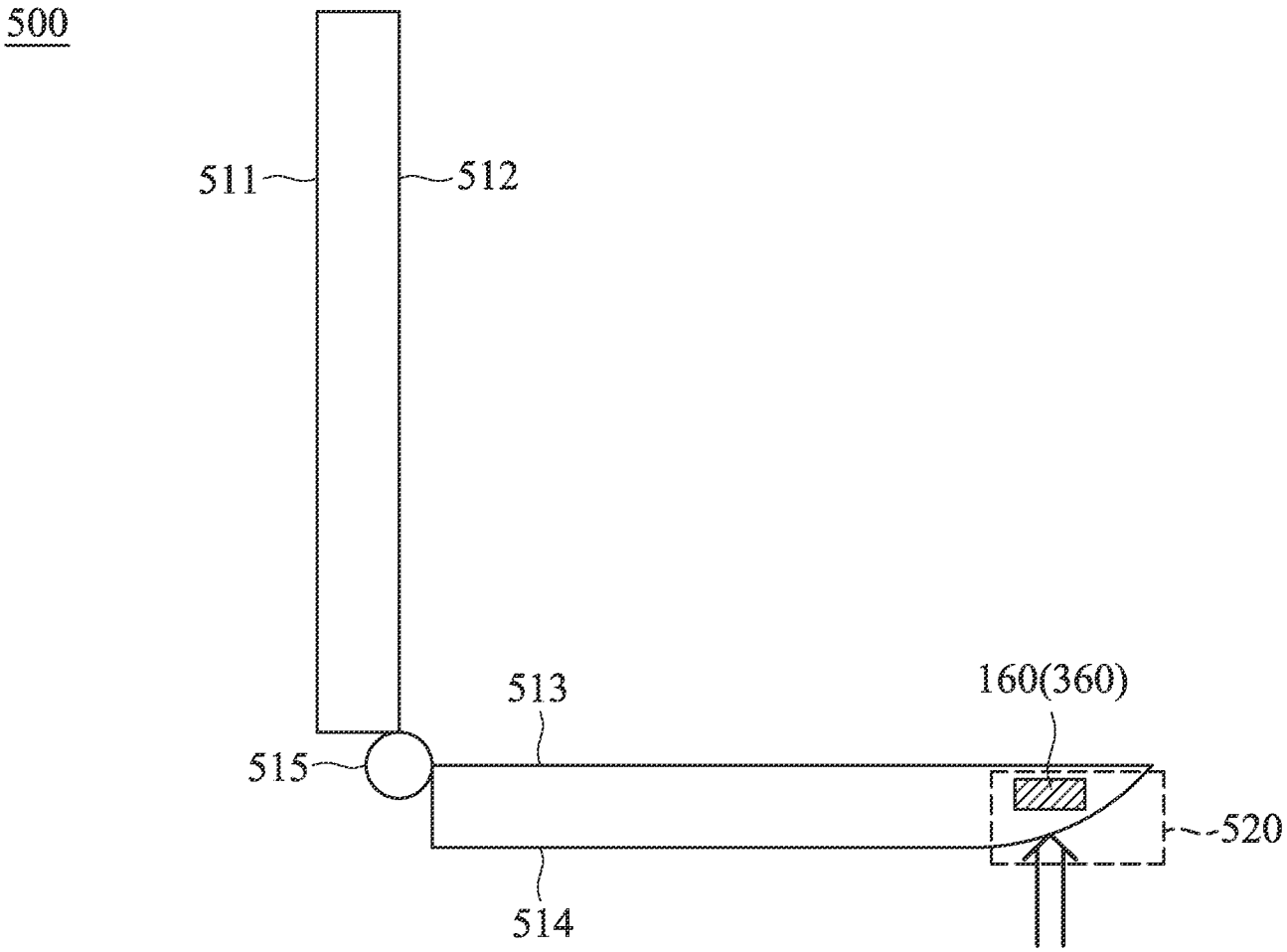
FIG. 5 is a diagram of a convertible mobile device operating in a notebook mode according to an embodiment of the invention.
Figure 6:
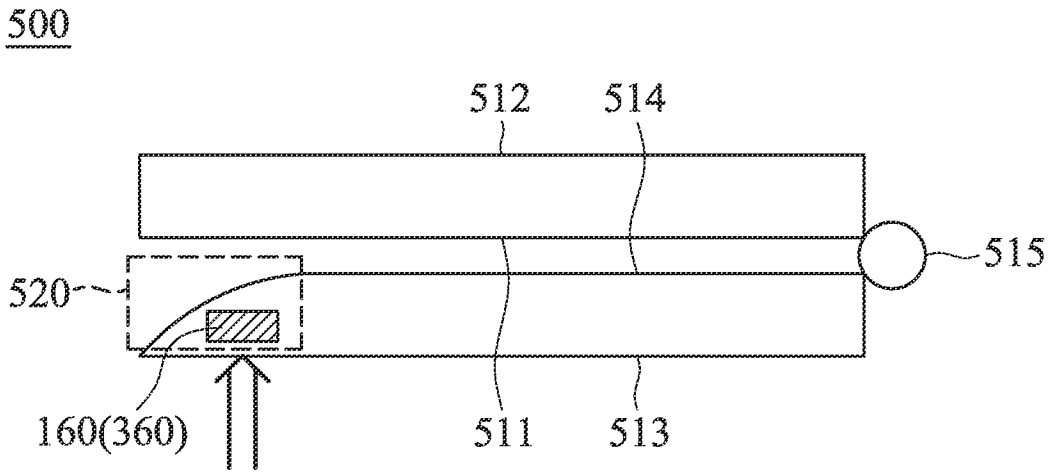
FIG. 6 is a diagram of a convertible mobile device operating in a tablet mode according to an embodiment of the invention.

FIG. 5 is a diagram of the convertible mobile device 500 operating in the notebook mode according to an embodiment of the invention. FIG. 6 is a diagram of the convertible mobile device 500 operating in the tablet mode according to an embodiment of the invention. The arrows in FIG. 5 and FIG. 6 represent the probing directions of SAR (Specific Absorption Rate) test. According to practical measurements, the antenna structure 160 (or 360) of the invention can effectively overcome the negative influence caused by its too short distance to the metal back cover 514, regardless of the mobile device 500 operating in the tablet mode or notebook mode. Therefore, the convertible mobile device 500 including the antenna structure 160 (or 360) can easily pass the SAR test prescribed by laws.

The invention proposes a novel mobile device and a novel antenna structure for covering WLAN frequency bands. Even if the proposed antenna structure is applied to a cutting retraction region of a metal back cover, it can still reduce the original SAR by 50% or more. In comparison to the convention design, the invention has at least the advantages of small size, low SAR, wide bandwidth, and low manufacturing cost, and therefore it is suitable for application in a variety of mobile communication devices.

Note that the above element sizes, element shapes, and frequency ranges are not limitations of the invention. An antenna designer can fine-tune these settings or values according to different requirements. It should be understood that the mobile device and antenna structure of the invention are not limited to the configurations of FIGS. 1-6. The invention may merely include any one or more features of any one or more embodiments of FIGS. 1-6. In other words, not all of the features displayed in the figures should be implemented in the mobile device and antenna structure of the invention.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mobile device, comprising:

a main radiation element, having a first notch, wherein the main radiation element comprises a feeding region coupled to a signal source and a grounding region coupled to a ground voltage;

a parasitic radiation element, coupled to the ground voltage, wherein the parasitic radiation element is adjacent to the feeding region; and an additional radiation element, coupled to the main radiation element, wherein the additional radiation element and the parasitic radiation element substantially extend in a same direction;

wherein an antenna structure is formed by the main radiation element, the parasitic radiation element, and the additional radiation element;

wherein the main radiation element has a first corner, a second corner, a third corner, and a fourth corner;

wherein a first current path is formed from the feeding region through the second corner and the first notch to the third corner;

wherein the antenna structure covers a first frequency band from 2400 MHz to 2500 MHz, a second frequency band from 5100 MHz to 5600 MHz, and a third frequency band from 5600 MHz to 5900 MHz;

wherein a length of the first current path is substantially equal to 0.25 wavelength of the first frequency band;

wherein a second current path is formed from an open end of the additional radiation element through the second corner and the first notch to the third corner;

wherein a length of the second current path is substantially equal to 0.5 wavelength of the second frequency band.

2. The mobile device as claimed in claim 1, wherein the feeding region is positioned at the first corner.

3. The mobile device as claimed in claim 1, wherein the additional radiation element is coupled to the second corner.

4. The mobile device as claimed in claim 1, wherein the parasitic radiation element substantially has an L-shape.

5. The mobile device as claimed in claim 1, wherein the additional radiation element substantially has a straight-line shape.

6. The mobile device as claimed in claim 1, wherein the first notch of the main radiation element is positioned between the second corner and the third corner.

7. The mobile device as claimed in claim 1, wherein the main radiation element further has a second notch adjacent to the fourth corner.

8. The mobile device as claimed in claim 1, wherein a coupling gap is formed between the parasitic radiation element and the main radiation element, and a width of the coupling gap is shorter than or equal to 1 mm.

9. The mobile device as claimed in claim 1, wherein a distance between the additional radiation element and the parasitic radiation element is longer than or equal to 7 mm.

10. The mobile device as claimed in claim 1, wherein a length of the parasitic radiation element is substantially equal to 0.25 wavelength of the third frequency band.

11. The mobile device as claimed in claim 1, further comprising:

a metal back cover, comprising a cutting retraction region.

12. The mobile device as claimed in claim 11, further comprising:

a keyboard frame, wherein the antenna structure is disposed between the keyboard frame and the metal back cover.

13. The mobile device as claimed in claim 12, wherein the antenna structure has a vertical projection on the metal back cover, and the whole vertical projection is inside the cutting retraction region.

* * * * *